United States Patent [19]

Colman et al.

[11] 4,237,006

[45] Dec. 2, 1980

[54] CYCLONE SEPARATOR

[75] Inventors: Derek A. Colman, Lordswood; Martin T. Thew, Bitterne, both of England

[73] Assignee: National Research Development Corporation, London, England

[21] Appl. No.: 42,227

[22] Filed: May 24, 1979

[30] Foreign Application Priority Data

May 31, 1978 [GB] United Kingdom ..... 25956/78

[51] Int. Cl.[3] ..... B04C 5/081

[52] U.S. Cl. ..... 210/84; 210/512 R

[58] Field of Search ..... 210/84, 322, 512 A, 210/512 M, 252, 261, 262; 55/447

[56] References Cited

U.S. PATENT DOCUMENTS

| | | | |
|---|---|---|---|
| 2,364,405 | 5/1944 | Trimbey et al. | 210/84 |
| 3,850,816 | 11/1974 | Koch | 210/512 |
| 3,917,718 | 7/1976 | Reid | 210/84 |

*Primary Examiner*—John Adee

*Attorney, Agent, or Firm*—Cushman, Darby & Cushman

[57] ABSTRACT

A cyclone separator having a generally cylindrical first portion with a plurality of tangentially directed feeds, and, adjacent to the first portion and coaxial therewith, a generally cylindrical second portion open at its far end, the first portion having an axial overflow outlet opposite the second portion, the second portion opening at its far end into a coaxial generally cylindrical third portion, the internal diameter of the axial overflow outlet being $d_0$, of the first portion being $d_1$, of the second portion being $d_2$ and of the third portion being $d_3$, the internal length of the first portion being $l_1$ and of the second portion being $l_2$, wherein the total cross-sectional area of all the feeds measured at the points of entry normal to the inlet flow is $A_i$ and wherein the shape of the separator is governed by the following relationships:

$10 \leqq l_2/d_2 \leqq 25$ $0.04 \leqq 4A_i/\pi d_1^2 \leqq 0.10$ $0.1 \leqq d_0/d_2 \leqq 0.25$ $d_1 > d_2$ $d_2 > d_3$.

19 Claims, 1 Drawing Figure

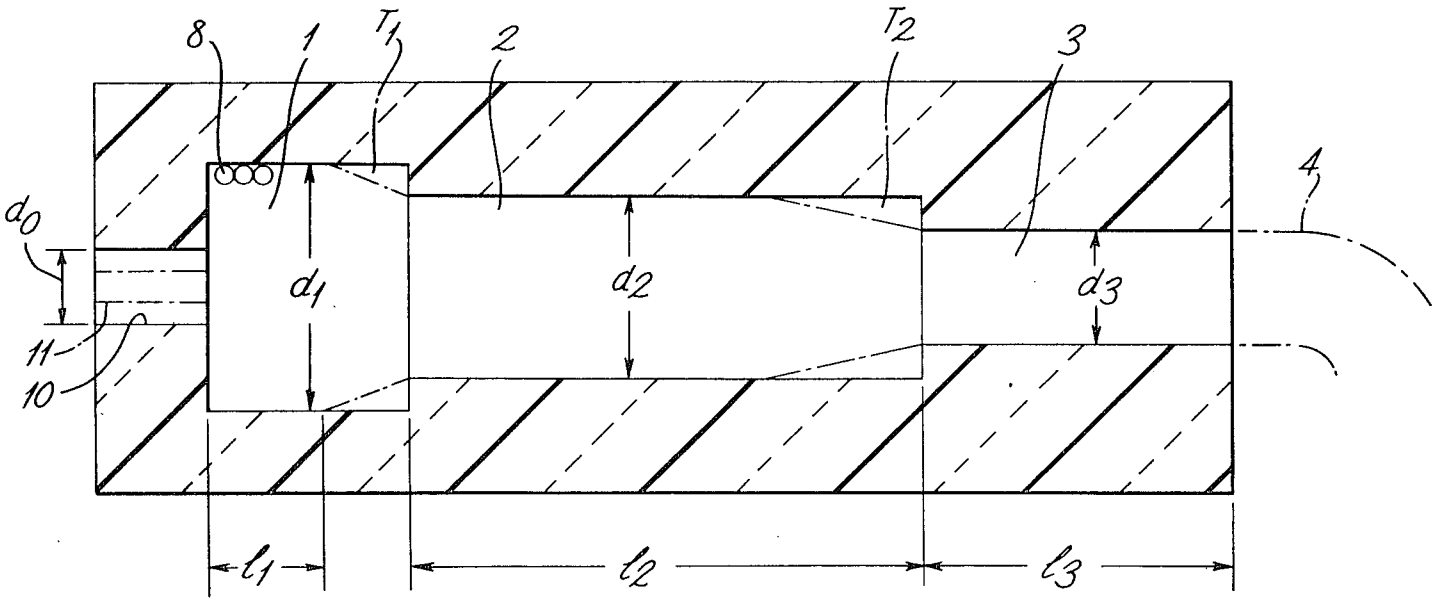
4
3
T2
2
T1
1
8
d3
d2
d1
d0
11
10
l3
l2
l1

CYCLONE SEPARATOR

This invention is about a cyclone separator. This separator may find application in removing a lighter phase from a large volume of a denser phase, such as oil from water, with minimum contamination of the more voluminous phase. Most conventional separators are designed for the opposite purpose, that is removing a denser phase from a large volume of a lighter phase, with minimum contamination of the less voluminous phase.

This invention is a cyclone separator defined as follows. The cyclone separator has a generally cylindrical first portion with a plurality of substantially equally circumferentially spaced tangentially directed feeds, and, adjacent to the first portion and coaxial therewith, a generally cylindrical second portion open at its far end. The first portion has an axial overflow outlet opposite the second portion. The second portion opens at its far end into a coaxial generally cylindrical third portion. The internal diameter of the axial overflow outlet is $d_o$, of the first portion is $d_1$, of the second portion is $d_2$ and of the third portion is $d_3$. The internal length of the first portion is $l_1$ and of the second portion is $l_2$. The total cross-sectional area of all the feeds measured at the points of entry normal to the inlet flow is $A_i$. The shape of the separator is governed by the following relationships:

$10 \leqq l_2/d_2 \leqq 25$ $0.04 \leqq 4A_i/\pi d_1^2 \leqq 0.10$ $0.1 \leqq d_0/d_2 \leqq 0.25$ $d_1 > d_2$ $d_2 > d_3$.

Preferably, $d_3/d_2$ is from 0.5 to 0.8. Preferably, where the internal length of the third portion is $l_3$, $l_3/d_3$ is at least 15 and may be as large as desired, preferably at least 40. $l_1/d_1$ may be from 0.5 to 5. $d_1/d_2$ may be from 1.5 to 3. For maximum discrimination with especially dilute lighter phases, a temptation might be to minimise $d_0$ but, if overdone, this is undesirable, and it is better to provide, within the axial overflow outlet of diameter $d_0$ defined above, a further concentric outlet tube of the desired narrowness. Material leaving by the axial overflow outlet and not by its concentric outlet tube may be returned to the cyclone separator for further treatment, via any one or more of the feeds.

A flow-smoothing taper may be interposed between the first portion and the second portion, preferably in the form of a frustoconical internal surface whose larger-diameter end has a diameter $d_1$ and whose smaller-diameter end has a diameter $d_2$ and whose conicity (half-angle) is preferably at least 10°.

Another possible site for a flow-smoothing taper is in the downstream end of the second portion. This likewise preferably has the form of a frustoconical internal surface whose larger-diameter has a diameter $d_2$ and whose smaller-diameter end has a diameter $d_3$ and whose conicity (half-angle) may be from 20′ to 20°. Optionally the conicity is such that concity (half-angle)$=\arctan((d_2-d_3)/2l_2)$, i.e. of such slight angle that the taper occupies the whole length of the separating portion. In such cases the conicity (half-angle) is preferably from 20′ to 1°.

The actual magnitude of $d_2$ is a matter of choice for operating and engineering convenience, and may for example be 10 to 100 mm.

Further successively narrower fourth, fifth . . . portions may be added, but it is likely that they will increase the energy consumption to an extent outweighing the benefits of extra separation efficiency.

The invention extends to a method of removing a lighter phase from a larger volume of a denser phase, comprising applying the phases to the feeds of a cyclone separator as set forth above, the phases being at a higher pressure than the axial overflow outlet and the far end of the third (or last) portion.

This method is particularly envisaged for removing oil (lighter phase) from water (denser phase), such as sea water, which may have become contaminated with oil, as a result of spillage, shipwreck, oil-rig blow-out or routine operations such as bilge-rinsing or oil-rig drilling.

As liquids normally become less viscous when warm, water for example being only half as viscous at 50° C. as at 20° C., the method is advantageously performed at as high a temperature as convenient.

The invention extends to the products of the method (such as concentrated oil, or cleaned water).

The invention will now be described by way of example with reference to the accompanying drawing, which shows, schematically, a cyclone separator according to the invention. The drawing is not to scale.

A generally cylindrical first portion 1 has two equally-circumferentially-spaced feeds 8 (only one shown) which are directed tangentially, both in the same sense, into the first portion 1. Coaxial with the first portion 1, and adjacent to it, is a generally cylindrical second portion 2, which opens at its far end into a coaxial generally cylindrical third portion 3. The third portion 3 opens into collection ducting 4.

The first portion 1 has an axial overflow outlet 10 opposite the second portion 2, and in one embodiment this contains a narrower concentric outlet tube 11.

In the present cyclone separator, the actual relationships are as follows:

$$d_1/d_2=2.$$

This is a compromise between energy-saving and space-saving considerations, which on their own would lead to ratios of around 3 and 1.5 respectively.

$$d_3/d_2=0.5.$$

$$l_1/d_1=2.5.$$

Values of from 1.5 to 4 work well.

$$l_2/d_2=16 \text{ to } 20.$$

The second portion 2 should not be too long.

$$l_3/d_3=42.5.$$

This ratio should be as large as possible.

$$d_0/d_2=0.14.$$

If this ratio is too large, too much of the denser phase overflows with the lighter phase through the axial overflow outlet 10. If the ratio is too small, the vortex may be disturbed, and for separating minute proportions of a lighter phase the outlet tube 11 may be employed within the outlet 10 of the above diameter. With these exemplary dimensions, about 10% by volume of the material treated in the cyclone separator overflows through the axial overflow outlet 10.

$$4A_i/\pi d_1^2 = 1/16.$$

This expresses the ratio of the inlet feeds cross-sectional area to the first portion cross-sectional area.

$$d_2 = 30 \text{ mm}.$$

This depends on the use of the cyclone separator. For separating oil from water, $d_2$ may conveniently be 20 mm, but $d_2$ can for many purposes be anywhere within the range 10–100 mm, for example 15–60 mm; with excessively large $d_2$, the energy consumption becomes large, while with too small $d_2$ Reynolds number effects and excessive shear stresses arise.

The cyclone separator can be in any orientation with insignificant effect.

The ratio of the radial to the axial extent of the opening of each feed 8 is 1:3, and this may be achieved as shown by drilling three adjacent holes or alternatively by machining a rectangular opening. This ratio may reach 1:4.5, but is less successful when approaching 1:2. The distance of the nearest inlet from the upstream end wall should not exceed about $d_1/3$.

To separate oil from water, the oil/water mixture is introduced (for example at 50° C.) through the feeds 8 at a pressure exceeding that in the ducting 4 or in the axial overflow outlet 10 (including the outlet tube 11 if present). The mixture spirals within the first portion 1 and its angular velocity increases as it enters the second portion 2. A flow-smoothing taper $T_1$ of angle to the axis 45° may be provided interposed between the first and second portions. Alternatively worded, 45° is the conicity (half-angle) of the frustum represented by $T_1$.

The bulk of the oil separates within an axial vortex in the second portion 2. The spiralling flow of the water plus remaining oil then enters the third portion 3, over a further optional flow-smoothing taper $T_2$ in the second portion of small conicity; 10° is better than 20°. In a further embodiment of the invention, the taper $T_2$ may be of such slight angle as to occupy the whole length $l_2$. That is, the angle which the taper $T_2$ makes with the axis is 52′, and, where $d_3/d_2$ is 0.5, this makes $l_2$ of magnitude about $16d_2$. The remaining oil separates within a continuation of the axial vortex in the third portion 3. The cleaned water leaves through the collection ducting 4 and may be collected, for return to the sea, for example.

The oil entrained in the vortex moves axially to the axial overflow outlet 10 and may be collected for dumping, storage or further separation, since it probably still contains some water. If the outlet tube 11 is present, this more selectively collects the oil, and the material issuing from the outlet 10 other than through the tube 11 may be recycled to the feeds 8 (at its original pressure).

We claim:

1. A cyclone separator, having:

an internally generally cylindrical first portion with a plurality of tangentially directed feeds, axially adjacent to said cylindrical first portion but for an annular transitional internal surface means providing a first step, and coaxial therewith, an internally generally cylindrical second portion open at its far end thereby providing a denser phase outlet from said cylindrical second portion, said cylindrical second portion being characterized by the absence of feed inlets except over said first step from said cylindrical first portion;

said first cylindrical portion having an axial overflow outlet for less dense phase at its far end distally of the cylindrical second portion; and axially adjacent to said cylindrical second portion but for an annular transitional internal surface means providing a second step, and coaxial therewith, an internally generally cylindrical third portion open at its far end thereby providing a denser phase outlet from said cylindrical third portion, said cylindrical third portion being characterized by the absence of feed inlets except over said second step from said cylindrical second portion;

the internal shape of said separator being governed by the following relationships:

$10 \leqq l_2/d_2 \leqq 25$ $0.04 \leqq 4A_i/\pi d_1^2 \leqq 0.10$ $0.1 \leqq d_0/d_2 \leqq 0.25$ $d_1 > d_2$ $d_2 > d_3$.

wherein:

$d_0$ = the internal diameter of said axial overflow outlet, $d_1$ = the internal diameter of said cylindrical first portion, $d_2$ = the internal diameter of said cylindrical second portion, $d_3$ = the internal diameter of said cylindrical third portion, $l_2$ = the internal length of said cylindrical second portion, and $A_i$ = the total cross sectional area of all of said feeds into said cylindrical first portion measured at points of entry normal to inlet flow.

2. A cyclone separator according to claim 1 wherein the internal length of the third portion is $l_3$ and wherein $l_3/d_3$ is at least 15.

3. A cyclone separator according to claim 2, wherein $l_3/d_3$ is at least 40.

4. A cyclone separator according to claim 1, wherein $d_3/d_2$ is from 0.5 to 0.8.

5. A cyclone separator according to claim 1, wherein the axial overflow outlet further comprises a concentric outlet tube of diameter less than $d_0$.

6. A cyclone separator according to claim 1 wherein the internal length of said flow portion is $l_1$ and wherein $l_1/d_1$ is from 0.5 to 5.

7. A cyclone separator according to claim 6, wherein $l_1/d_1$ is from 1.5 to 4.

8. A cyclone separator according to claim 1, wherein $d_1/d_2$ is from 1.5 to 3.

9. A cyclone separator according to claim 1, said first step comprising a flow-smoothing taper interposed between the first portion and the second portion.

10. A cyclone separator according to claim 9, wherein the flow-smoothing taper is in the form of a frusto-conical internal surface whose larger-diameter end has a diameter $d_1$ and whose smaller-diameter end has a diameter $d_2$.

11. A cyclone separator according to claim 10, wherein the conicity (half-angle) of the taper is at least 10°.

12. A cyclone separator according to claim 1, said second step comprising a flow-smoothing taper in the downstream end of the second portion.

13. A cyclone separator according to claim 12, wherein said taper is in the form of a frustoconical internal surface whose larger-diameter end has a diameter $d_2$ and whose smaller-diameter end has a diameter $d_3$.

14. A cyclone separator according to claim 13, wherein the conicity (half-angle) of said taper is from 20′ to 20°.

15. A cyclone separator according to claim 14, wherein the conicity (half-angle) of the taper referred to in claim 12 is defined by arctan $((d_2-d_3)/2l_2)$.

16. A cyclone separator according to claim 1, wherein $d_2$ is from 10 to 100 mm.

17. A method for removing a less dense liquid phase from a relatively large volume of more dense liquid phase, comprising:

injecting a mixture of the two phases through a plurality of substantially spaced tangential feeds into the internally generally cylindrical first portion of a cyclone separator which also has, axially adjacent to the cylindrical first portion but for an annular transitional internal surface means providing a step, and coaxial with said cylindrical first portion, an internally generally cylindrical second portion open at its far end distally of said cylindrical first portion to provide a denser-phase outlet, this cylindrical second portion being characterized by the absence of feed inlets except over said step from said cylindrical first portion, the cylindrical first portion having an axial overflow outlet for the less dense phase at its far end distally of the cylindrical second portion; and axially adjacent to said cylindrical second portion but for an annular transitional internal surface means providing a second step, and coaxial therewith, an internally generally cylindrical third portion open at its far end thereby providing a denser phase outlet from said cylindrical third portion, said cylindrical third portion being characterized by the absence of feed inlets except over said second step from said cylindrical second portion;

the internal shape of said separator being governed by the following relationships:

$10 \leqq l_2/d_2 \leqq 25$ $0.04 \leqq 4A_i/\pi d_1^2 \leqq 0.10$ $0.1 \leqq d_0/d_2 \leqq 0.25$ $d_1 > d_2$ $d_2 > d_3$.

wherein:

$d_0$ = the internal diameter of said axial overflow outlet, $d_1$ = the internal diameter of said cylindrical first portion, $d_2$ = the internal diameter of said cylindrical second portion, $d_3$ = the internal diameter of said cylindrical third portion, $l_2$ = the internal length of said cylindrical second portion, and $A_i$ = the total cross sectional area of all of said feeds into said cylindrical first portion measured at points of entry normal to inlet flow collecting less dense phase leaving the cyclone separator via the axial overflow outlet for the less dense phase;

the pressure of injection at said feeds being greater than the pressure at said axial overflow outlet and greater than the pressure at said denser-phase outlet.

18. A method according to claim 17, wherein the lighter phase is oil and the denser phase is water.

19. A method according to claim 17, further comprising:

coaxially providing said axial overflow outlet with an outlet tube having an external diameter that is substantially smaller than $d_0$, thereby dividing said axial overflow outlet into a central portion which is located centrally of the outlet tube and a radially outer portion which is located circumferentially of the exterior of the outlet tube; and recycling to said feeds the liquid overflow of said radially outer portion of said axial overflow outlet.

* * * * *